US009963326B2

(12) United States Patent
Berry

(10) Patent No.: US 9,963,326 B2
(45) Date of Patent: May 8, 2018

(54) MULTI-PATH HOISTING SYSTEMS

(71) Applicant: Cameron International Corporation, Houston, TX (US)

(72) Inventor: Joe R. Berry, Cypress, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 426 days.

(21) Appl. No.: 14/711,954

(22) Filed: May 14, 2015

(65) Prior Publication Data

US 2016/0185577 A1 Jun. 30, 2016

Related U.S. Application Data

(60) Provisional application No. 62/098,234, filed on Dec. 30, 2014.

(51) Int. Cl.

| | |
|---|---|
| ***B66D 1/26*** | (2006.01) |
| ***E21B 19/00*** | (2006.01) |
| ***B66D 1/52*** | (2006.01) |
| ***E21B 19/09*** | (2006.01) |

(52) U.S. Cl.

CPC ..... *B66D 1/26* (2013.01); *B66D 1/52* (2013.01); *E21B 19/008* (2013.01); *E21B 19/09* (2013.01)

(58) Field of Classification Search

CPC ... B66D 1/26; B66D 1/34; B66D 1/36; B66D 1/50; B66D 1/52; B66D 3/043; B66D 3/06; B66D 3/08; E21B 19/008; E21B 19/084; E21B 19/09

See application file for complete search history.

(56) References Cited

U.S. PATENT DOCUMENTS

| | | | | |
|---|---|---|---|---|
| 3,653,636 | A | 4/1972 | Burrell | |
| 3,834,672 | A | 9/1974 | Hawley et al. | |
| 4,290,495 | A * | 9/1981 | Elliston | E21B 7/02 166/77.4 |
| 5,257,891 | A * | 11/1993 | Baumann | B66C 1/101 212/274 |
| 5,579,931 | A * | 12/1996 | Zuehlke | B66C 13/18 212/274 |
| 5,894,895 | A | 4/1999 | Welsh | |
| 7,165,759 | B2 | 1/2007 | Welsh | |
| 7,975,987 | B2 * | 7/2011 | Shin | B66C 13/08 212/83 |
| 2007/0290182 | A1 * | 12/2007 | Noeske | B66C 13/18 254/327 |
| 2012/0025156 | A1 * | 2/2012 | Roodenburg | E21B 19/02 254/337 |
| 2012/0199800 | A1 * | 8/2012 | Slob | B66C 23/12 254/264 |
| 2014/0014015 | A1 | 1/2014 | Roodenburg et al. | |

FOREIGN PATENT DOCUMENTS

| | | |
|---|---|---|
| WO | 2014/209131 | 12/2014 |

* cited by examiner

*Primary Examiner* — Emmanuel M Marcelo
(74) *Attorney, Agent, or Firm* — Helene Raybaud

(57) ABSTRACT

Various hoisting systems using multiple hoisting lines in shared block-and-tackle arrangements are provided. In one embodiment, an apparatus includes a hoisting system with multiple hoisting lines wound on a rotatable drum of a drawworks. The hoisting lines are continuous wire ropes that are reeved over a shared crown block and around a shared traveling block in a block-and-tackle arrangement to provide a mechanical advantage. Additional systems, devices, and methods are also disclosed.

19 Claims, 5 Drawing Sheets

MULTI-PATH HOISTING SYSTEMS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Drilling rigs can use hoisting systems for raising and lowering equipment in wells. As operators have moved to deeper waters and deeper wells, the weight of the equipment to be hoisted by drilling rigs (e.g., drill strings, casing strings, and wellhead equipment) has increased. Multi-part block-and-tackle arrangements have been used with drawworks for hoisting on drilling rigs, in which hoisting lines are reeved through sheaves of crown blocks and traveling blocks to provide a mechanical advantage. Past approaches to increasing the hoisting capabilities of such arrangements have included adding more sheaves in the block-and-tackle arrangements to allow for more line parts supporting the loads, and increasing the sizes of hoisting lines so that each hoisting line part can support greater weights.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to hoisting systems using multiple, separate hoisting lines reeved through a crown block and a traveling block in a shared block-and-tackle arrangement. In some embodiments, the multiple hoisting lines are each wound on shared drum of a drawworks. The multiple hoisting lines can be reeled in or out together from the drum to move a hoisted load coupled to the traveling block. In at least one embodiment, the hoisting lines are connected to dead-line anchors mounted on a stabilizer that balances tensions in portions of the hoisting lines.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
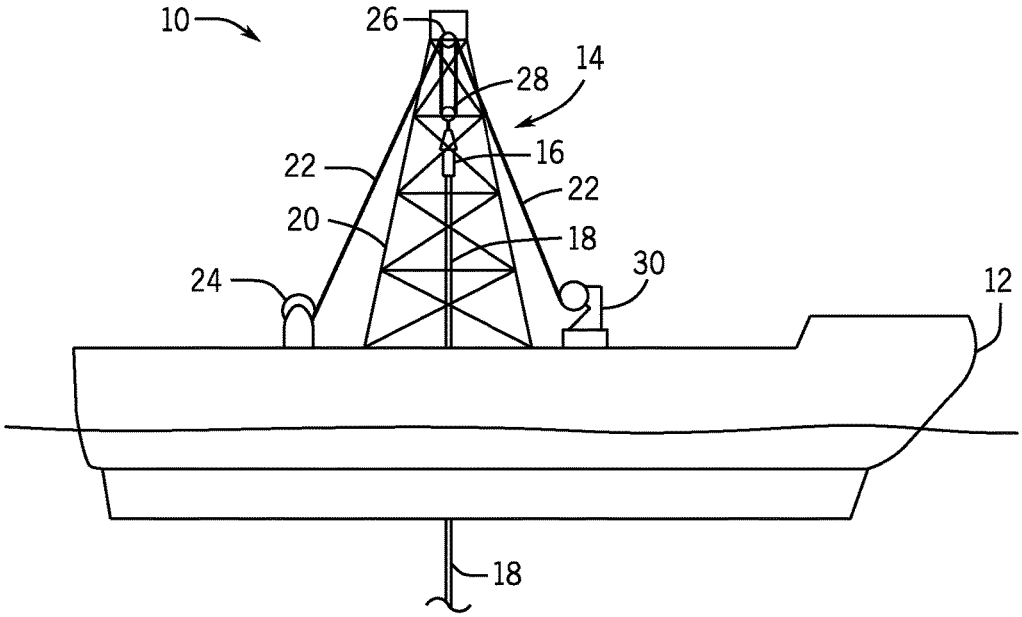
FIG. 1 generally depicts a floating drilling rig with a hoisting system in accordance with one embodiment of the present disclosure.

Turning now to the present figures, a system 10 is illustrated in FIG. 1 in accordance with one embodiment. In this example, the system 10 is an offshore drilling rig in the form of a floating vessel 12. More specifically, the floating vessel 12 is generally depicted as a drillship in FIG. 1, but the floating vessel could be provided in another form, such as a semi-submersible drilling rig, in other embodiments.

The vessel 12 includes a hoisting system 14 for raising and lowering a supported load with respect to a drill floor of the vessel. For instance, the hoisting system 14 can be used to raise and lower a top drive 16 coupled to a drill string 18, as generally shown in FIG. 1, to facilitate well drilling and completion operations. More specifically, the drill string 18 extends through a hole in the drill floor of the vessel 12 and can be rotated by the top drive 16 to drill a subsea well. But it will be appreciated that the hoisting system 14 could also or instead be used for hoisting other loads.

Figure 2:
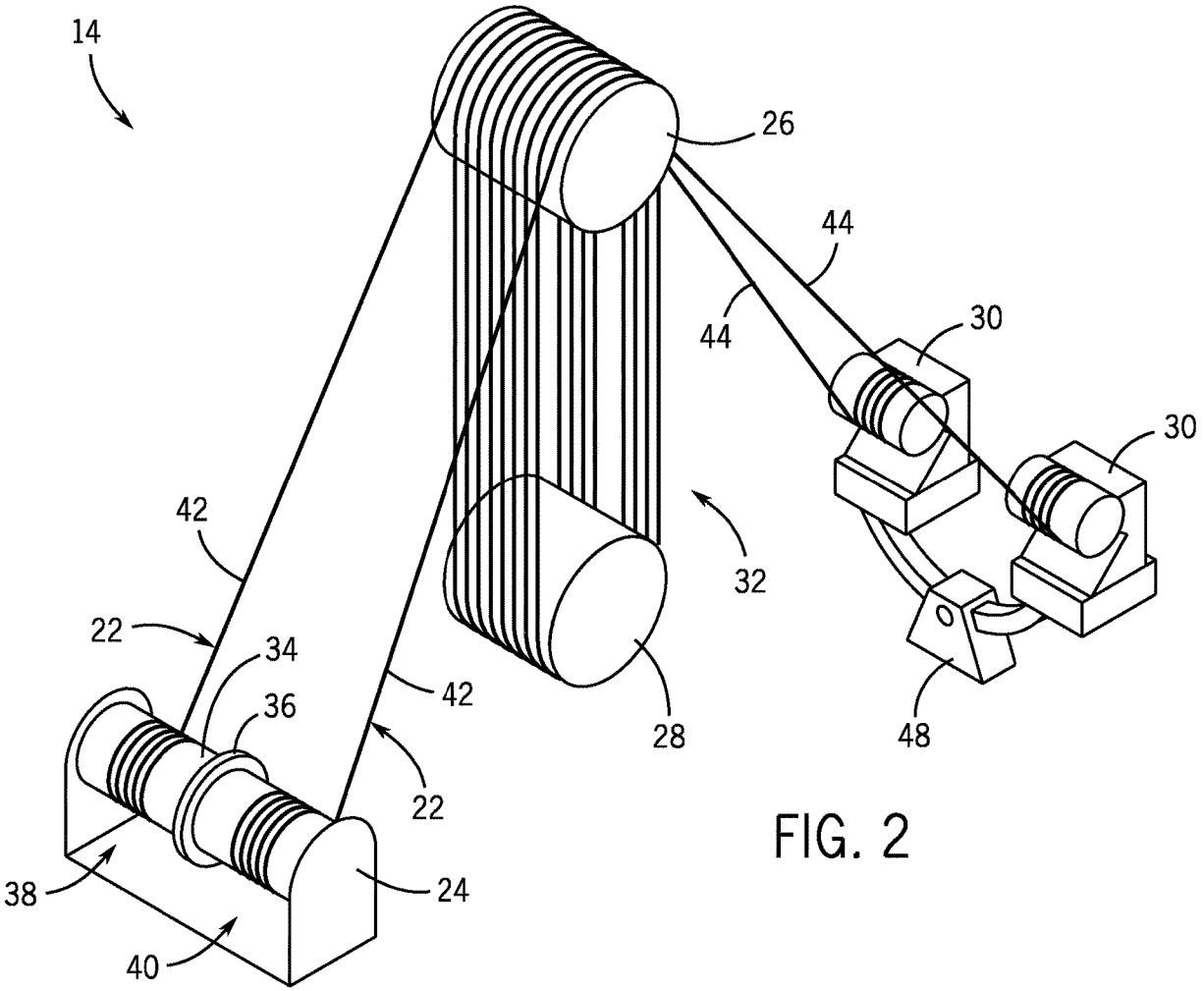
FIG. 2 is a perspective view of a hoisting system with two separate hoisting lines reeved in a shared block-and-tackle arrangement in accordance with one embodiment.
Figure 3:
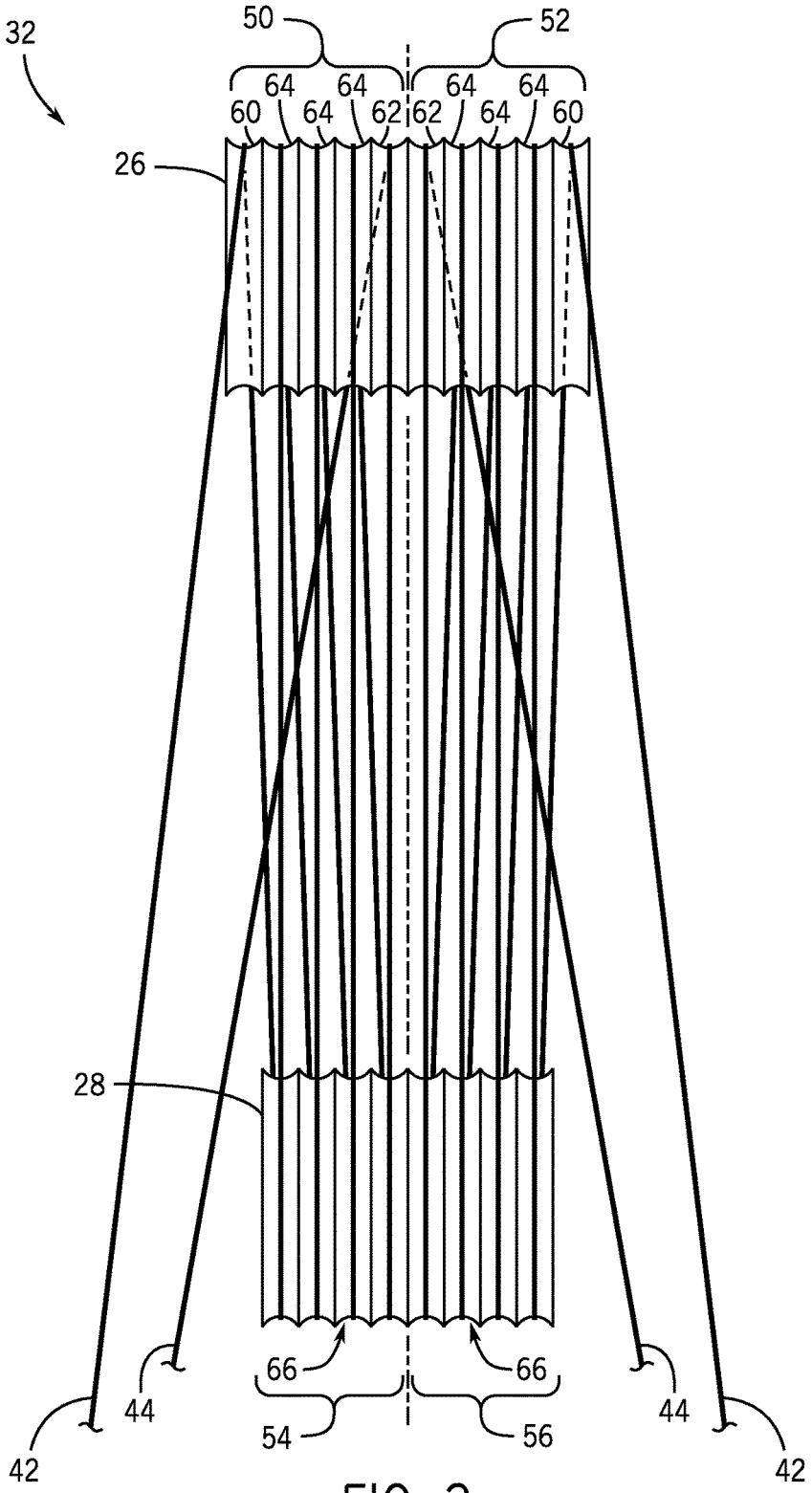
FIG. 3 is an elevational view of the shared block-and-tackle arrangement of FIG. 2 and shows the two separate hoisting lines reeved through sheaves of a crown block and a traveling block in accordance with one embodiment.

The depicted hoisting system 14 includes a derrick 20 constructed on the drill floor of the vessel 12. In some other embodiments, the hoisting system 14 includes a mast instead of a derrick 20. The hoisting system 14 also includes hoisting lines 22 for supporting the top drive 16 and drill string 18 (or other loads). The hoisting lines 22 are continuous wire ropes that are reeled in and out from a rotatable drum of a drawworks 24. The number of hoisting lines 22 can vary between different embodiments. In some embodiments, an example of which is depicted in FIGS. 2 and 3, the hoisting system 14 includes just two hoisting lines 22. In other embodiments, such as that depicted in FIGS. 4 and 5, the hoisting system 14 uses four hoisting lines 22.

The hoisting system 14 includes a crown block 26 and a traveling block 28. In the presently depicted embodiment, the crown block 26 is connected to the derrick 20 and the traveling block 28 is suspended from the crown block 26 by the hoisting lines 22. Each of the blocks 26 and 28 include multiple sheaves, and the hoisting lines 22 are reeved through the sheaves of the crown block 26 and of the traveling block 28 to provide a mechanical advantage for lifting the top drive 16 and drill string 18. The magnitude of this mechanical advantage depends on the number of parts in the lines 22 that bear the weight of the top drive 16 and drill string 18. The supported top drive 16 and drill string 18 can be raised and lowered by reeling in or reeling out the hoisting lines 22 from the rotatable drum of the drawworks 24.

The ends of the hoisting lines 22 opposite the drawworks 24 are coupled to dead-line anchors 30. As generally shown in FIG. 1, a dead-line anchor 30 includes a drum about which a hoisting line 22 can be wound. The dead-line anchors 30 can be mounted on a drill floor (as generally depicted in FIG. 1), on a leg of the derrick 20, or on some other component that is fixed with respect to the derrick 20. The dead-line anchors 30 can include sensors (e.g., strain gauges) for measuring hook load on the top drive 16.

As noted above, one approach to increasing hoisting capacity of a hoisting system is to increase the number of sheaves in crown blocks and traveling blocks of a block-and-tackle arrangement. This enables a hoisting line to be reeved through the additional sheaves to increase the number of line parts supporting the connected load and increase the mechanical advantage. Another approach is to increase the size of the hoisting line so that each line part is able to support a greater weight. But one drawback to these approaches is that it adds friction to the system, reducing its efficiency. And because the traveling speed of the hoisted load is inversely related to the number of line parts supporting the hoisted load, adding additional sheaves and supporting line parts reduces the traveling speed of the hoisted load relative to the rotational speed of a drawworks drum.

By way of example, a 1000-ton or 1250-ton hoisting system can have a two-inch diameter hoisting line with sixteen parts in a block-and-tackle reeving with sixteen or seventeen sheaves. Such a system can have significant efficiency losses due to friction. Still further, the hoisting speed of the traveling block and supported load in such a system would be one-sixteenth (or less) that of the speed at which the hoisting line is reeled in or out from the rotatable drum. In one such arrangement, a fast-line speed of about 24 meters per second may provide a hoisting speed of about 1.4 meters per second. The inertia effects of the rotating systems and the high speed of the fast line can further reduce efficiency of the hoisting system.

Certain embodiments of the present technique, however, include a hoisting system using multiple, separate hoisting lines to reduce the friction and inertia effects associated with the conventional approach of adding sheaves and increasing the number of parts of the line in the reeving to increase the mechanical advantage. One example of a hoisting system 14 with a pair of separate hoisting lines 22 is generally depicted in FIG. 2. In this embodiment, the two hoisting lines 22 are both reeved in a shared block-and-tackle arrangement 32 and wound around a rotatable drum 34 of the drawworks 24. The rotatable drum 34 includes a divider 36 that separates the drum 34 into separate portions 38 and 40. One of the hoisting lines 22 can be wound on the portion 38 and the other can be wound on the portion 40 to keep the lines 22 separate on the drum 34 and avoid tangling of the two lines 22. Each of the hoisting lines 22 includes a fast line 42 (i.e., the portion of the line 22 extending from the drum 34 to the crown block 26). The hoisting lines 22 are reeved through a shared crown block 26 and a shared traveling block 28 of the block-and-tackle arrangement 32.

Each of the hoisting lines 22 also includes a dead line 44 extending from the crown block 26 down to its own dead-line anchor 30. As shown here, each of the dead-line anchors 30 is coupled to a stabilizer 48 to balance tension in the two dead lines 44. Although the stabilizer 48 can take any suitable form, it is generally depicted in FIG. 2 as a mechanical balance. In this embodiment, unequal tensions in the dead lines 44 would cause the beam of the balance to tip so that the dead-line anchor 30 coupled to the dead line 44 having greater tension moves closer to the crown block 26, and the dead-line anchor 30 coupled to the dead line 44 having less tension moves further from the crown block 26, to balance the tensions in the dead lines 44. In other embodiments, the dead-line anchors 30 are not coupled to a stabilizer 48, or only one of the dead-line anchors is coupled to a stabilizer 48.

From the above, it will be appreciated that the hoisting system 14 of FIG. 2 can be considered a dual-path hoisting system, as it has two fast lines 42 reeled from the drum 34, two multi-part reevings in a shared block-and-tackle arrangement 32, and two dead lines 44 connected to anchors 30. When the drum 34 is rotated, both hoisting lines 22 are reeled in or out to change the position of the hoisted load. Each of the two hoisting lines 22 is reeved through the crown block 26 and the traveling block 28 in an eight-part arrangement, in which eight parts of each hoisting line 22 extend upward from the traveling block 28 to support a hoisted load. With two hoisting lines 22, this provides the shared block-and-tackle arrangement 32 as a sixteen-part arrangement, with eight parts provided by each hoisting line 22. This allows the hoisting system 14 to achieve the same hoisting capacity as a traditional sixteen-part arrangement using a single hoisting line. But even when both arrangements support a hoisted load with a sixteen-part block-and-tackle, the dual-line arrangement (i.e., using two hoisting lines 22 in the block-and-tackle arrangement 32) has lower friction than the single-line arrangement. Additionally, the use of two hoisting lines 22 allows the drum 34 to be rotated at half the speed of a comparable single-line system to provide the same hoisting speed at the traveling block 28. Also, the fast-line speed in the dual-line system 14 is half the fast-line speed of the comparable single-line system for a given hoisting speed for the traveling block 28. In at least some instances, this difference could be used to provide greater hoisting speed capability in the dual-line system.

An example of the block-and-tackle arrangement 32 with the two hoisting lines 22 is shown in detail in FIG. 3. As noted above, the crown block 26 and the traveling block 28 include multiple sheaves. The crown block 26 includes two portions 50 and 52 and the traveling block 28 includes two portions 54 and 56. One of the hoisting lines 22 is reeved through sheaves of portions 50 and 54, while the other hoisting line 22 is reeved through sheaves of portions 52 and 56. Although not depicted in FIG. 3, it will be appreciated that the crown and traveling blocks 26 and 28 can include other components. For example, the blocks 26 and 28 can include axles on which the sheaves are mounted. The blocks 26 and 28 can also include covers or other housings that protect the sheaves and facilitate coupling of the blocks to other components (e.g., coupling of the crown block 26 to the derrick 20 and coupling of the traveling block 28 to the top drive 16).

In the depicted arrangement, the portions 50 and 52 of the crown block 26 each include a fast-line sheave 60, a dead-line sheave 62, and three additional sheaves 64, while the portions 54 and 56 of the traveling block 28 each include four sheaves 66. Each hoisting line 22 includes a fast-line portion 42 that extends from the drum 34 up to the crown block 26 and is reeved over its fast-line sheave 60, a portion reeved back-and-forth in successive loops through sheaves 66 of the traveling block and sheaves 64 of the crown block 26, and a dead-line portion 44 that is reeved over the dead-line sheave 62 and extends from the crown block 26 down to an anchor point (e.g., dead-line anchor 30).

Figure 4:
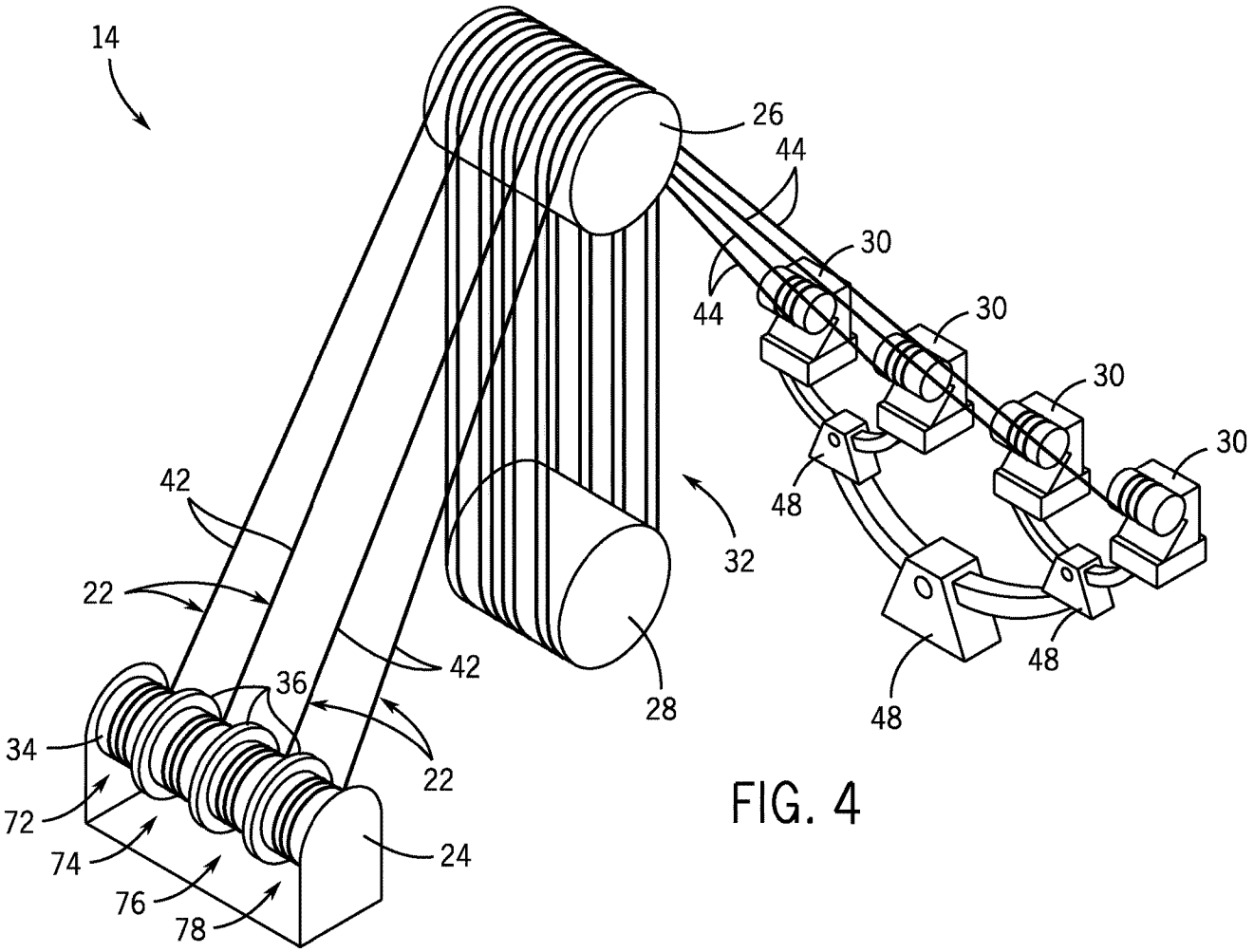
FIG. 4 is a perspective view of a hoisting system with four separate hoisting lines reeved in a shared block-and-tackle arrangement in accordance with one embodiment.
Figure 5:
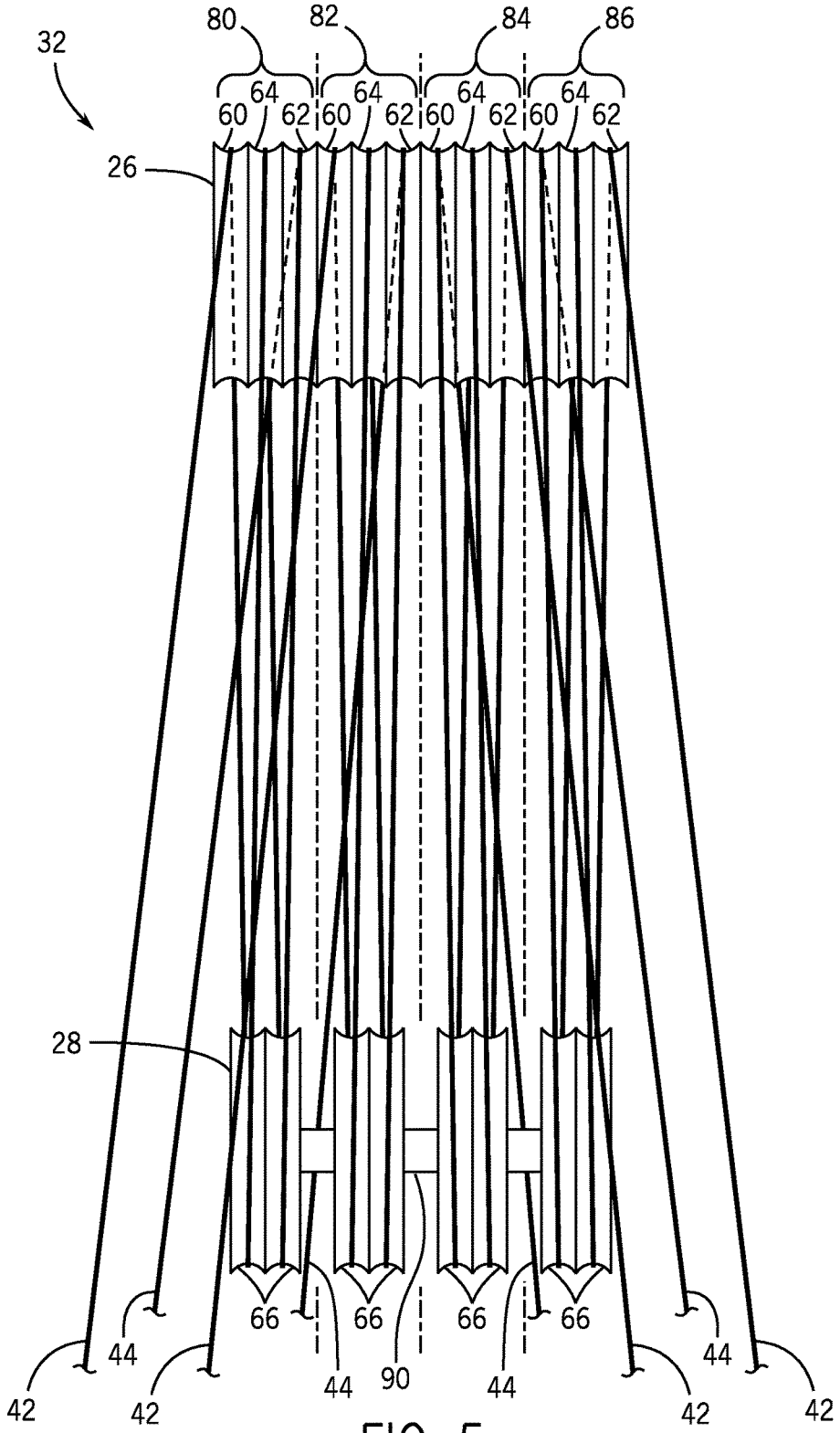
FIG. 5 is an elevational view of the shared block-and-tackle arrangement of FIG. 4 and shows the four separate hoisting lines reeved through sheaves of a crown block and a traveling block in accordance with one embodiment.

While the hoisting system 14 can be provided as a dual-path hoisting system with two hoisting lines 22, the hoisting system 14 could be provided as a multi-path hoisting system with more than two hoisting lines 22 in other embodiments. For instance, a quad-line hoisting system 14 with four hoisting lines 22 is generally depicted in FIGS. 4 and 5. But other multi-path hoisting systems 14 could include three hoisting lines 22 (e.g., in a twelve-part or eighteen-part shared block-and-tackle arrangement, with four or six parts provided by each hoisting line 22) or more than four hoisting lines 22 in accordance with the present techniques.

The quad-line hoisting system 14 of FIG. 4 includes four hoisting lines 22 wound on portions 72, 74, 76, and 78 of the drum 34. The hoisting lines 22 are reeved in a shared block-and-tackle arrangement 32, and each hoisting line 22 includes a fast line 42 and a dead line 44 that is connected to an individual dead-line anchor 30. The dead-line anchors 30 are coupled to a group of stabilizers 48. As shown here, the stabilizers 48 include two mechanical balances each coupled to two of the dead-line anchors 30 and a third mechanical balance coupled to the other mechanical balances. The beams of the mechanical balances can tip to balance tensions in the dead lines 44. Although each of the dead-line anchors 30 is shown here (like in FIG. 2) coupled to a stabilizer 48, in other embodiments none, or only some, of the dead-line anchors 30 are coupled to a stabilizer 48.

An example of the shared block-and-tackle arrangement 32 for a quad-line hoisting system 14 is generally depicted in FIG. 5. In this example, each of the hoisting lines 22 is reeved through the sheaves of the crown block 26 and the traveling block 28 in a four-part arrangement, in which four parts of each hoisting line 22 extend upward from the traveling block 28 to support the connected load. This provides the shared block-and-tackle arrangement 32 as a sixteen-part arrangement (divided between the four hoisting lines 22). Also, with four hoisting lines 22 being reeled in and out from the drum 34, the drum 34 can be rotated at a quarter of the speed as that which would be required in a comparable single-line system to achieve a given hoisting speed.

The sheaves of the block-and-tackle arrangement 32 are generally divided into four groups 80, 82, 84, and 86, and a different one of the four hoisting lines 22 is reeved through each of these four groups of sheaves. As depicted in FIG. 5, each hoisting line 22 is reeved over a fast-line sheave 60 of the crown block 26, down around a sheave 66 of the traveling block 28 (shown here on an axle 90), up around a sheave 64 of the crown block 26, down around an additional sheave 66, and up around a dead-line sheave 62. For each hoisting line 22, the fast line 42 is wound on the drum 34 and the dead line 44 is connected to a dead-line anchor 30.

As noted above, hoisting systems 14 can be used to hoist loads on a floating vessel 12. Because these vessels float at the surface of the water and are not anchored to the seabed with legs, the vessels can vertically rise and fall (i.e., heave) with waves in the water. Heave compensation can be used to counteract the vertical heaving motion and reduce movement of the drill string 18 or other hoisted load with respect to the seabed. In at least some embodiments, the hoisting system 14 includes both active heave compensation and passive heave compensation to compensate for heaving motion of the floating vessel 12 from wave action at the surface of the water.

Figure 6:
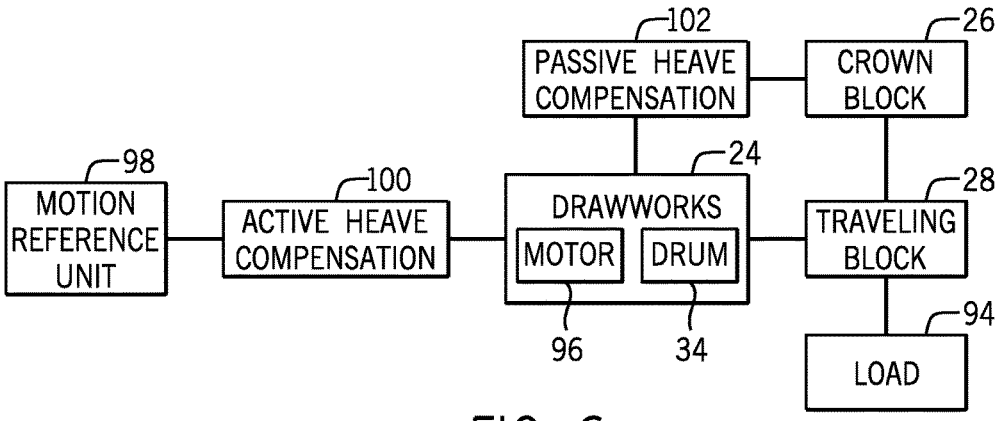
FIG. 6 is a block diagram representing a hoisting system having both active and passive heave compensation functions in accordance with one embodiment.

One such embodiment is generally depicted in FIG. 6 by way of example. In this figure, a load 94 (e.g., the top drive 16 and drill string 18) is supported by a hoisting system including the drawworks 24, the crown block 26, and the traveling block 28. As described above, multiple hoisting lines 22 can be wound on a drum 34 of the drawworks 24 and reeved through the crown block 26 and the traveling block 28 to support the load 94 and gain a mechanical advantage. One or more motors 96 of the drawworks 24 can be used (with or without gearboxes) to drive rotation of the drum 34 (e.g., to reel multiple hoisting lines in and raise the connected load 94). As the traveling block 28 and its connected load 94 are suspended from the crown block 26 with the hoisting lines 22, heave of the vessel 12 causes the load 94 to move up and down with respect to the underlying seabed. During drilling operations, such movement can cause a drill bit at the end of the drill string 18 to be pulled off the bottom of the well (with upward heave) or to be pushed with greater force against the bottom if the well (with downward heave).

To compensate for the heaving motion and reduce deviation of the hoisted load 94 with respect to the seabed, the hoisting system in FIG. 6 includes an active heave compensation system 100 and a passive heave compensation system 102. A motion reference unit 98 can be used to detect the heave of the vessel 12. In at least some embodiments, the active heave compensation system 100 uses the measured heave to actively compensate for heaving motion through control of the drawworks 24. For instance, the active heave compensation system 100 can include a controller (e.g., a programmable logic controller or a programmed general-purpose computer) that receives the measured heave as an input and controls operation of the drawworks 24 to raise and lower the load 94 (with respect to the drill floor) to compensate for the heaving motion. The controller can control operation in any suitable manner, such as by sending command signals to motors 96 of the drawworks 24 that control rotation of the drum 34. These motors 96 can be considered part of the active heave compensation system 100 as well.

By using multiple hoisting lines 22, the multi-path hoisting systems 14 described above allow the drum 34 to rotate significantly slower, and with a corresponding slower fast-line speed, to achieve a given hoisting speed of the traveling block 28 and its connected load 94 (compared to a hoisting system with only a single hoisting line in a similar block-and-tackle arrangement). The slower rotation of the drum 34 and the slower speed of the fast lines 42 of the hoisting lines 22 gives the multi-path systems 14 less inertia. This, in turn, makes it easier to apply active heave compensation to the system. For instance, the lower inertia in such systems may allow the one or more motors 96 to be provided as smaller motors 96 with less horsepower than that which would have been required to achieve the same amount of compensation in a hoisting system with only one hoisting line.

The passive heave compensation system 102 can also be used to counter heaving motion of the vessel 12. In contrast to the active heave compensation system 100, the passive heave compensation system 102 can counter heave without requiring external power. For example, the passive heave compensation system 102 can include one or more hydraulic devices (e.g., hydraulic cylinders or hydraulic motors) that passively store and release energy from the heaving motion of the vessel 12 to move the load 94 with respect to the drill floor to reduce the deviation of the load 94 from its position with respect to the seabed. In some instances, the passive heave compensation system 102 could also include an active component (e.g., a hydraulic cylinder that passively compensates for heave and that can also be actively driven for further heave compensation).

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a hoisting system including:

multiple hoisting lines;

a drawworks having a rotatable drum for reeling in and reeling out the multiple hoisting lines;

a crown block shared by the multiple hoisting lines;

a traveling block shared by the multiple hoisting lines; and multiple dead-line anchors;

wherein each of the multiple hoisting lines is a continuous wire rope that is wound on the rotatable drum of the drawworks, and is reeved over the crown block shared by the multiple hoisting lines and around the traveling block shared by the multiple hoisting lines in a block-and-tackle arrangement of the multiple hoisting lines with the crown block and the traveling block to provide a mechanical advantage, and wherein each of the multiple hoisting lines is coupled to a separate dead-line anchor of the multiple dead-line anchors.

2. The apparatus of claim 1, wherein at least one of the multiple dead-line anchors is coupled to at least one stabilizer to facilitate balancing of tension in dead-line portions of the multiple hoisting lines.

3. The apparatus of claim 2, wherein each of the multiple dead-line anchors is coupled to the at least one stabilizer to facilitate balancing of tension in the dead-line portions of the multiple hoisting lines.

4. The apparatus of claim 1, wherein the multiple hoisting lines include just a first hoisting line and a second hoisting line.

5. The apparatus of claim 4, wherein the block-and-tackle arrangement is a sixteen-part block-and-tackle arrangement in which the first hoisting line and the second hoisting line each provide eight parts of the sixteen-part block-and-tackle arrangement.

6. The apparatus of claim 1, wherein the multiple hoisting lines include four hoisting lines.

7. The apparatus of claim 6, wherein the block-and-tackle arrangement is a sixteen-part block-and-tackle arrangement.

8. The apparatus of claim 7, wherein each of the four hoisting lines provides four parts of the sixteen-part block-and-tackle arrangement.

9. The apparatus of claim 1, comprising a floating vessel having the hoisting system.

10. The apparatus of claim 9, wherein the floating vessel is a drillship.

11. A hoisting system comprising:

a crown block including a plurality of sheaves, the plurality of sheaves of the crown block including at least two fast-line sheaves;

a traveling block including a plurality of sheaves;

a rotatable drum;

a first hoisting line that extends from the rotatable drum and is reeved over a first fast-line sheave of the at least two fast-line sheaves and through other sheaves of the crown block and the traveling block; and a second hoisting line that extends from the same rotatable drum from which the first hoisting line extends and is reeved over a second fast-line sheave of the at least two fast-line sheaves and through other sheaves of the crown block and the traveling block.

12. The hoisting system of claim 11, wherein the plurality of sheaves of the crown block include at least two dead-line sheaves, the first hoisting line is reeved over a first dead-line sheave of the at least two dead-line sheaves, and the second hoisting line is reeved over a second dead-line sheave of the at least two dead-line sheaves.

13. The hoisting system of claim 11, comprising a drawworks including the rotatable drum and a motor coupled to drive rotation of the rotatable drum.

14. The hoisting system of claim 13, wherein the hoisting system includes active heave control for controlling rotation of the rotatable drum with the motor in response to detected heave.

15. A method comprising:

reeving a first hoisting line through a crown block and a traveling block;

reeving a second hoisting line through the same crown block and the same traveling block through which the first hoisting line is reeved; and winding the first hoisting line and the second hoisting line around a shared drum of a drawworks.

16. The method of claim 15, comprising connecting each of the first and second hoisting lines to separate dead-line anchors.

17. The method of claim 16, comprising using the first and second hoisting lines to support a load coupled to the traveling block.

18. The method of claim 17, comprising moving at least one of the separate dead-line anchors to balance tension in dead-line portions of the first and second hoisting lines while supporting the load.

19. The method of claim 17, comprising:

reeling the first and second hoisting lines in or out in equal amounts through rotation of the shared drum of the drawworks to position the load; and applying active heave compensation to the drawworks to control rotation of the shared drum to compensate for detected heave.

* * * * *